US008545126B1

(12) United States Patent
Alsaffar

(10) Patent No.: US 8,545,126 B1
(45) Date of Patent: Oct. 1, 2013

(54) PORTABLE TRAFFIC SAFETY BARRIER

(71) Applicant: Abdulreidha Abdulrasoul Alsaffar, Mubarak Alkabeer (KW)

(72) Inventor: Abdulreidha Abdulrasoul Alsaffar, Mubarak Alkabeer (KW)

( * ) Notice: Subject to any disclaimer, the term of this patent is extended or adjusted under 35 U.S.C. 154(b) by 0 days.

(21) Appl. No.: 13/736,907

(22) Filed: Jan. 8, 2013

(51) Int. Cl.
*E01F 13/00* (2006.01)
*E01F 15/00* (2006.01)

(52) U.S. Cl.
USPC ..... 404/6; 256/13.1

(58) Field of Classification Search
USPC ..... 404/6, 9, 12; 403/321–330; 70/40, 70/48, 456 R, 459; 24/598.3, 600.5, 600.7; 256/13.1; 340/908.1
See application file for complete search history.

(56) References Cited

U.S. PATENT DOCUMENTS

| | | | | | |
|---|---|---|---|---|---|
| 1,442,096 | A | * | 1/1923 | Robinson | 24/598.3 |
| 2,222,053 | A | * | 11/1940 | Waller | 24/598.3 |
| 4,502,812 | A | * | 3/1985 | Zucker | 404/6 |
| 4,828,425 | A | | 5/1989 | Duckett | |
| 4,859,983 | A | | 8/1989 | Kulp et al. | |
| 5,007,763 | A | | 4/1991 | Burgett | |
| 5,074,704 | A | | 12/1991 | McKay | |
| 5,336,016 | A | | 8/1994 | Baatz | |
| 5,605,413 | A | * | 2/1997 | Brown | 404/6 |
| 5,641,241 | A | * | 6/1997 | Rushing | 404/6 |
| 5,685,665 | A | * | 11/1997 | Lembo | 404/6 |
| 5,882,140 | A | | 3/1999 | Yodock, Jr. et al. | |
| 6,439,801 | B1 | * | 8/2002 | Galiana et al. | 404/6 |
| 6,517,279 | B1 | * | 2/2003 | Camomilla et al. | 404/6 |
| 6,533,250 | B2 | * | 3/2003 | Arthur | 256/13.1 |
| 7,393,154 | B1 | | 7/2008 | Dyke et al. | |
| 7,416,364 | B2 | | 8/2008 | Yodock, III et al. | |
| 7,445,402 | B1 | * | 11/2008 | Chen | 404/6 |
| D596,062 | S | | 7/2009 | Yodock, III et al. | |
| 7,708,492 | B2 | * | 5/2010 | Carey | 404/6 |
| 8,388,257 | B2 | * | 3/2013 | Redlberger | 404/6 |
| 2002/0025221 | A1 | | 2/2002 | Johnson | |
| 2008/0286042 | A1 | * | 11/2008 | Dyke et al. | 404/6 |

* cited by examiner

*Primary Examiner* — Thomas B Will
*Assistant Examiner* — Abigail A Risic
(74) *Attorney, Agent, or Firm* — Richard C. Litman

(57) ABSTRACT

The portable traffic safety barrier is formed of plastic or recycled rubber, and has a narrower upper portion and wider cap atop the upper portion to form a mushroom-shaped cross section. Elongate passages are formed through each barrier section, and a spring is installed in at least one passage to connect the barriers resiliently to one another end-to-end. Another passage contains a flexible coiled electrical cord to provide power for lighting the barrier, the lighting being installed atop the barrier sections. The springs and coiled cord allow connected barriers to separate in the event of impact, while still maintaining the integrity of the assembly and lighting. Wheels may be provided beneath the barrier sections to allow lateral repositioning. Two or more rows of barriers may be arranged laterally, and the resulting gap between barriers serves as a planter box or for the installation of signage.

5 Claims, 5 Drawing Sheets

PORTABLE TRAFFIC SAFETY BARRIER

BACKGROUND OF THE INVENTION

1. Field of the Invention

The present invention relates generally to walls, barriers, and the like, and particularly to a portable traffic safety barrier having resilient mechanical and electrical connections between sections to maintain their connectivity in the event of displacement.

2. Description of the Related Art

Heavy traffic safety barriers have been known and used for some time to separate lanes of vehicle traffic in construction zones and other areas. These barriers have been conventionally formed of concrete. It has generally been felt that the sheer mass of such a barrier is sufficient to prevent its movement to any substantial degree in the event of vehicle impact. Accordingly, little or no effort has been expended to link such barriers to one another when they are placed to form an elongate assembly.

Moreover, it appears that there has been little or no interest in providing mobility for such barriers, again due to the need for the barrier to remain substantially in position in the event of a vehicle impact. Such heavy barriers are generally offloaded from a large flatbed trailer by a crane, and placed in position by the crane. While this technique certainly accomplishes the general goal of barrier installation at a site, it does not allow any "fine tuning" of the position(s) of the barrier(s) afterwards.

Some form of lighting and signage is essential in most traffic barrier installations, as they are often located in congested areas of heavy traffic flow and result in the temporary relocation of entrance and exit ramps and traffic lanes. The conventional concrete traffic barrier has no provision for lighting or signage, so that the installation of sign posts and lighting requires separate wiring runs and supports.

Thus, a portable traffic safety barrier solving the aforementioned problems is desired.

SUMMARY OF THE INVENTION

The portable traffic safety barrier is preferably formed of recycled rubber from tires or other sources, or plastic material, to provide both resilience and the mass desired for such a barrier. The barrier is preferably tapered from a relatively wide base to a narrower upper portion, and has a wider head extending across the narrow upper portion to form a mushroom-shaped cross section. Wheels or rollers may be provided for each barrier section, the axles of the rollers being oriented parallel to the lengths of the barrier sections to allow the barriers to be moved laterally in the event of impact or for repositioning the barrier. Alternatively, the barriers may be staked or anchored to the underlying surface.

Each barrier section includes a plurality of hollow longitudinal passages therethrough. At least one of the passages, and preferably two such passages, includes a resilient spring extending therethrough. The spring has an end extending to each end of the barrier section. The ends of the springs of adjacent barrier sections may be linked together by connectors that may be opened to release and closed to connect the spring ends of the barriers to one another. A flexible electrical cord or cable extends through another longitudinal passage of the barrier, preferably near the top of the barrier section. The cord or cable is preferably formed as a spiral to allow elongation in the event of separation of connected barrier sections. The cord or cable includes electrical connectors on each end thereof. A series of lights is provided atop each barrier. The lights are connected to the electrical cord or cable.

The tapered cross section of the barrier sections results in a lateral gap between adjacent barriers when they are arranged as a double row. This gap may be used to contain planters for decorative or ornamental purposes, and/or for the installation of various light poles, signage, and/or other purposes. The barrier sections may be anchored into the underlying surface in such semi-permanent installations.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The portable traffic safety barrier is a barrier having advantages over the conventional "Jersey Wall" or "Jersey Barrier" often seen along roadways and highways to separate traffic in congested areas and/or in construction zones. A plurality of the portable traffic safety barriers may be linked or connected end-to-end to form a continuous barrier, so that the individual barrier sections of the continuous barrier communicate resiliently with one another, both mechanically and electrically, to ensure an unbroken wall in the event of a vehicle impact against one or more of the barrier sections.

Figure 1:
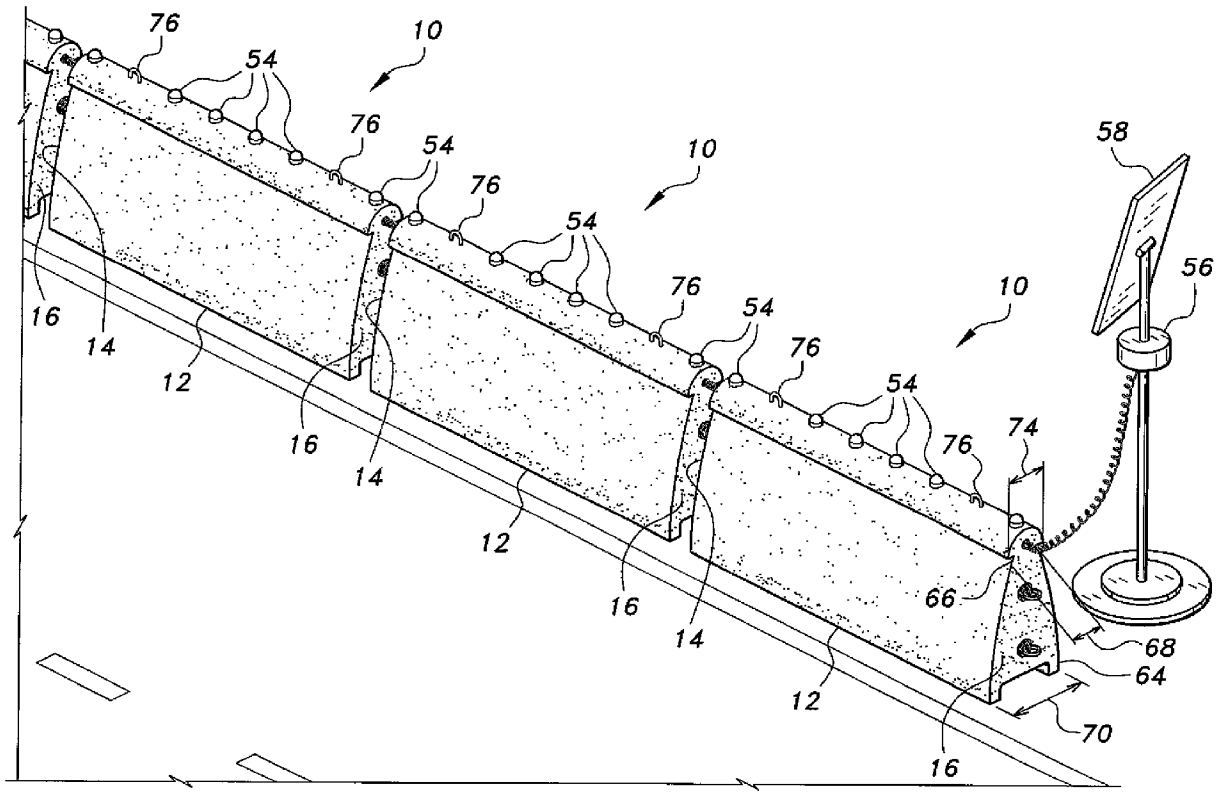
FIG. 1 is an environmental, perspective view of a plurality of portable traffic safety barriers according to the present invention, connected together to form an elongate barrier assembly.

FIG. 1 of the drawings is an environmental perspective view of a plurality of individual portable traffic safety barriers or barriers 10, linked or connected to one another end-to-end to form a continuous elongate structure. Each of the barriers comprises an elongate wall 12 having a first end 14, an opposite second end 16, and a plurality of longitudinally disposed passages 18, 20, and 22 formed therethrough from the first end 14 to the second end 16, as shown most clearly in the cross-sectional views of FIGS. 2A and 2B. The passages comprise a first spring passage 18, a second spring passage 20, and an electrical cord or cable passage 22. While only a single spring passage may be provided, each of the units 10 preferably includes two such spring passages 18 and 20, one above the other.

Figure 2A:
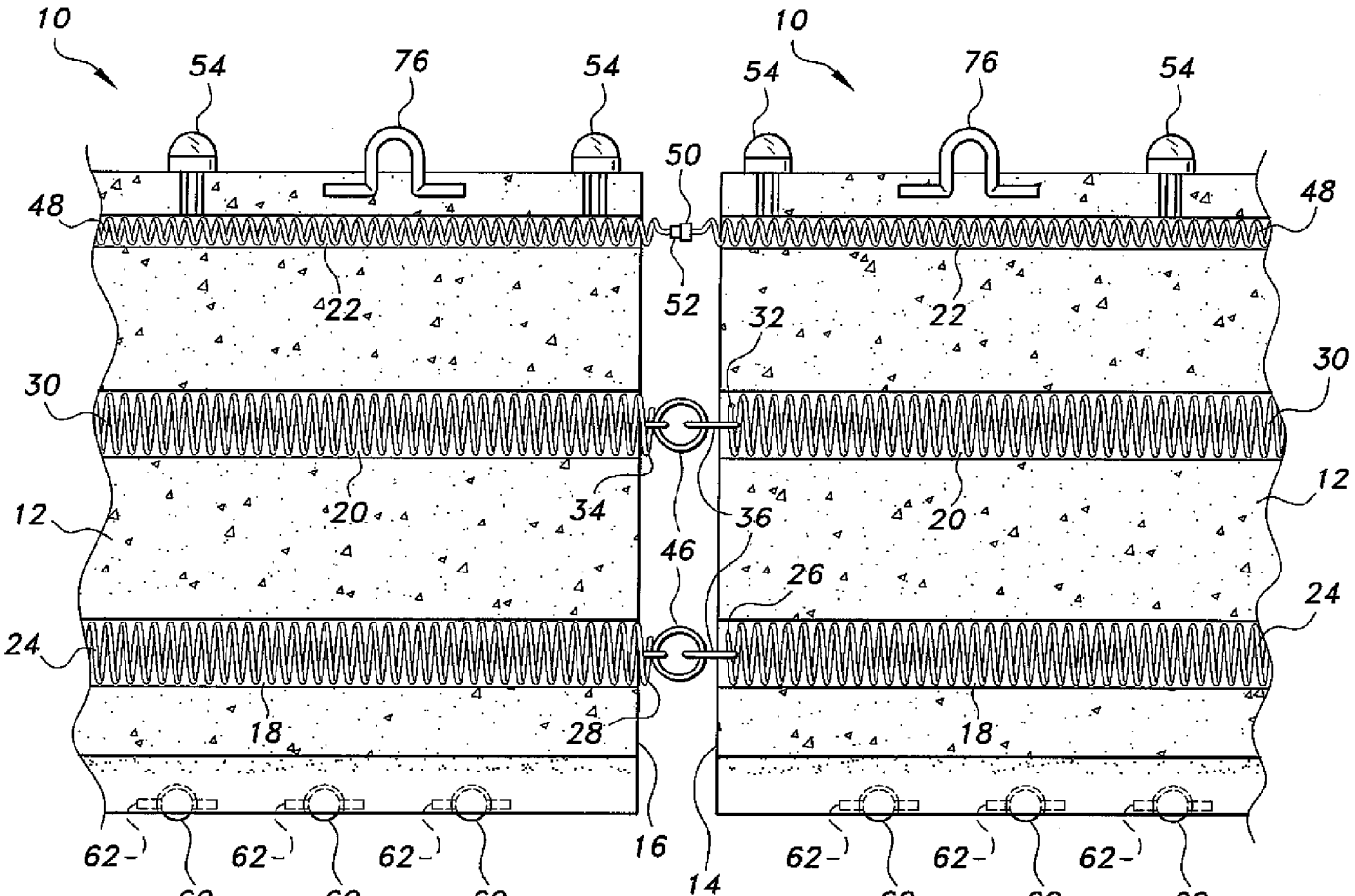
FIG. 2A is a partial side view in section of a pair of adjacent portable traffic safety barriers according to the present invention, showing the connection to one another of two of the portable traffic safety barriers.
Figure 2B:
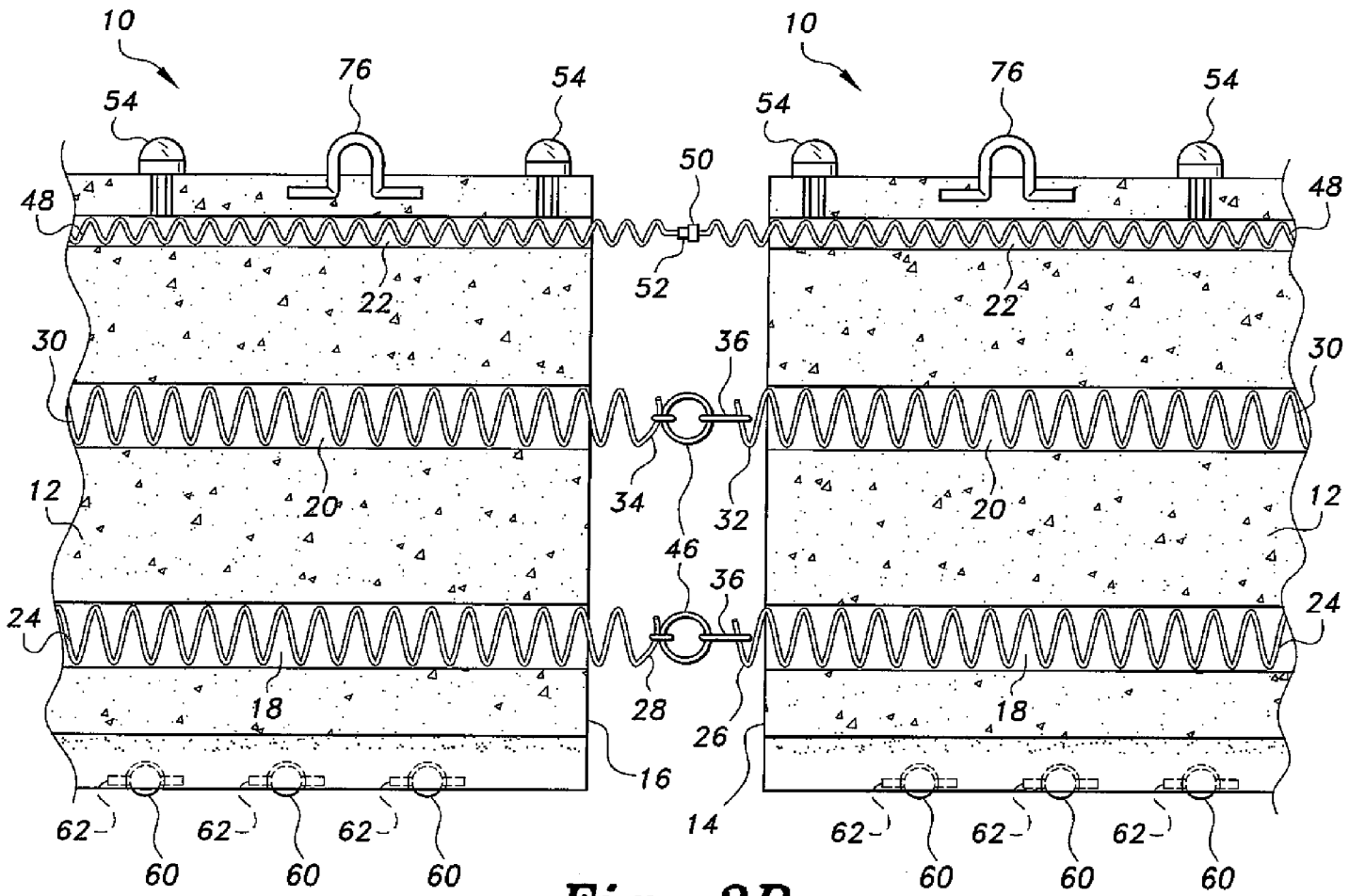
FIG. 2B is a partial side view in section of the portable traffic safety barriers of FIG. 2A, showing the connectors stretched when the two barriers are separated from one another.

A first spring 24 is installed in the first spring passage 18, as shown in FIGS. 2A and 2B. The spring 24 has a first end 26 disposed at the first end 14 of the wall 12 and opposite second end 28 disposed at the second end 16 of the wall 12. A second spring 30 is installed in the second spring passage 20, the second spring 30 having a first end 32 at the first end 14 of the wall 12 and an opposite second end 34 at the second end 16 of the wall 12.

Figure 3B:
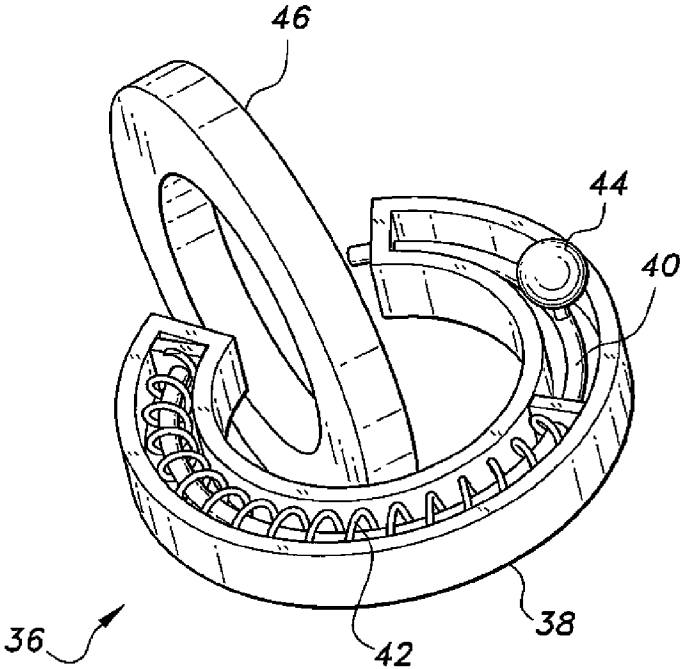
FIG. 3B is a perspective view showing the connector of FIG. 3A, shown with the connector being open.
Figure 3A:
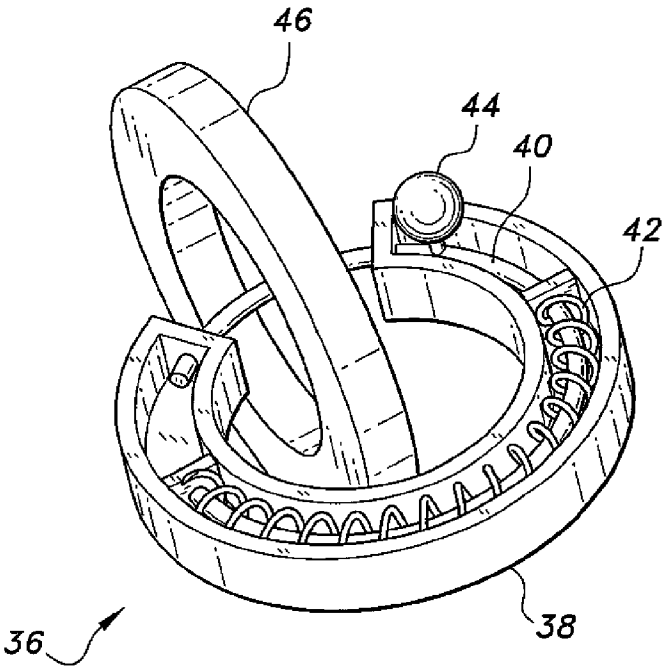
FIG. 3A is a perspective view showing one of the connectors of the portable traffic safety barrier according to the present invention, shown with the connector being closed.

End connectors are installed upon each of the spring ends 26, 28, 32, and 34 adjacent the respective wall ends 14 and 16 for releasably connecting the springs 24 and 30, and thus a plurality of walls 12, to one another. FIGS. 3A and 313 provide details of the two types of end connectors. Each of the first end connectors 36 comprises a ring having a semicircular outer portion 38 and a semicircular rod 40 slidingly disposed in a channel within the outer portion 38. (The internal channel is closed by a cover, not shown in FIGS. 3A and 3B for clarity.) The rod 40 is normally biased by a concentric spring 42 to extend from one end of the outer portion 38 of the ring to close the gap in the outer ring, as shown in FIG. 3A. A knob 44 extends through a slot in the cover to enable an operator to selectively retract the rod 40 further into the outer portion 38 of the ring to open the ring, as shown in FIG. 3B. Each of the second end connectors 46 comprises a permanently closed ring that is selectively linked to a corresponding first end connector 36 by means of the semicircular sliding rod mechanism of the first end connector 36, as described above.

Each of the electrical cord passages 22 shown in FIGS. 2A and 2B contains a resilient electrical cord 48 therein. Each cord 48 has a first end connector 50 disposed at the first end 14 of the respective wall 12, and an opposite second end connector 52 disposed at the opposite second end 16 of the wall 12. The two connectors 50 and 52 mate with one another both mechanically and electrically, and preferably form a twist-lock connection or other conventional positive connection to one another. The resilient electrical cords 48 are preferably coiled or otherwise compressed lengthwise in order to allow them to extend when a plurality of such cords 48 are connected to one another in adjacent walls 12 and the walls are spread apart from one another.

The electrical cord passage 22 is preferably located relatively high in each wall 12 and above the spring passages 18 and 20 to facilitate electrical connection to a plurality of electrically powered lights 54 disposed atop or elsewhere along the wall 12. The lights are preferably LED type, to provide good durability and longevity and relatively low current draw. Other lighting types or principles may be used in lieu of LEDs, however. The lights 54 may receive electrical power from a storage battery module 56 that, in turn, receives its charge from a solar panel 58 (as shown in FIGS. 1 and 4), or from some other conventional source of electrical power.

FIGS. 2A and 2B also illustrate the installation of wheels or rollers 60 beneath each of the walls 12. Each roller or wheel 60 may have the disc-like form of a conventional wheel, or may have a substantially spherical shape, as shown. The wheels 60 are not free swiveling, but are installed upon axles 62 that are immovably affixed in the bases of the walls 12. The axles 62 are longitudinally oriented parallel to the elongate dimensions of the walls 12, i.e., substantially parallel to the spring and electrical passages 18, 20, and 22. This permits the rollers or wheels 60 to rotate readily when the walls 12 are moved laterally, thus facilitating lateral movement of the walls to reduce resistance in the event of an impact. It also allows the walls 12 to be repositioned easily after such displacement. However, the walls 12 cannot be readily moved in a direction parallel to their longitudinal axes. Alternatively, the barrier 10 may be staked or anchored to the underlying surface by passing appropriate stakes or pins through passages in the wall elements 12 or through either of the end connector rings 36 or 46.

The individual barriers 10 or wall units 12 are preferably cast or otherwise formed of recycled rubber recovered from used tires, or from a dense plastic material. The use of such materials precludes cracking, shattering, or other significant damage due to vehicle impact, unlike relatively brittle concrete commonly used in the construction of conventional traffic barriers. Each of the walls 12 is configured with a specific cross-sectional shape, as shown in FIG. 1, to optimize certain characteristics or functions of the walls. Each wall 12 has a relatively wide base portion 64 that rests upon two laterally spaced elongate legs or feet. Rollers 60, and their axles 62, may be installed in both of these legs or feet. The relatively wide base 64 provides substantial stability for the wall 12 to resist tipping in the event of lateral impact. The upper portion 66 of the wall extending upward from the base 64 tapers to a narrower lateral dimension 68 than the width 70 of the base 64. The resulting slope up and away from the direction of potential impact will deflect a vehicle up the wall 12 to redirect some of the impact force as a glancing blow, rather than acting as a blunt barrier that resists the impact forces and results in high deceleration forces upon the vehicle. A cap 72 is disposed atop the upper portion 66 of the wall 12. The cap has a width 74 intermediate between the greater width 70 of the base 64 and the narrow width 68 of the upper portion 66. This results in a somewhat "mushroom-shaped" cross section for the wall 12, as can be seen in FIG. 1. Lifting eyes or rings 76, along with the lights 54, may be installed in the upper surface of the cap 72.

Figure 4:
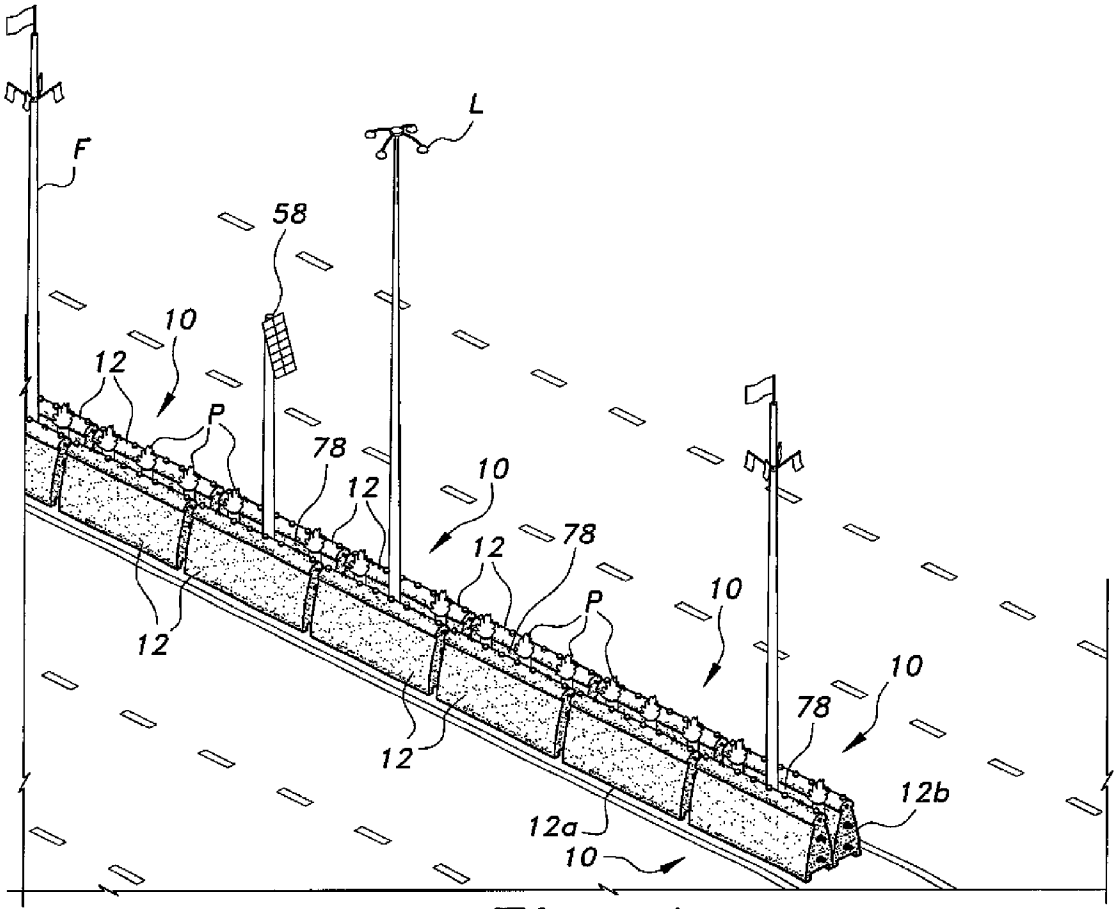
FIG. 4 is an environmental perspective view of an assembly of portable traffic safety barriers according to the present invention, showing their assembly in two laterally adjacent rows to form a planter and signage support gap therebetween.

FIG. 4 illustrates an environmental perspective view of an alternative arrangement of a plurality of walls 12 in which a first wall element 12*a* is set laterally adjacent a second wall element 12*b* to form a double-width barrier. The upwardly tapering cross-sectional shapes of the laterally adjacent wall elements 12*a* and 12*b* define an upwardly open enclosure 78 therebetween, which may be filled with soil or other suitable growth medium for use as a planter box for plants P disposed therein. This creates a more attractive environment for the motorist exposed to the portable traffic safety barriers 10. The enclosure 78 may also be used to anchor supports (e.g., flagpoles F, etc.) for the support of signage (e.g., flags, advertising or informational signs, etc.) and/or additional pole-supported lighting L. The additional lighting L may be powered in the same manner as described further above for the lights 54 installed atop the wall elements 12. The resulting portable traffic safety barrier 10 provides a barrier that is easier to move and install, more resistant to crash damage, more likely to reduce damage to vehicles impacting the barrier, more easily seen at night or in conditions of poor visibility, and more attractive to motorists traveling near the barrier 10.

It is to be understood that the present invention is not limited to the embodiments described above, but encompasses any and all embodiments within the scope of the following claims.

I claim:

1. A portable traffic safety barrier, comprising:

at least one elongate wall having a first end, a second end opposite the first end, a top surface, a bottom surface, and a plurality of longitudinally disposed passages extending therethrough from the first end of the wall to the second end of the wall, wherein the plurality of longitudinally disposed passages includes at least an upper passage adjacent the top surface and a lower passage;

a resilient spring disposed in the lower passage, the spring being at least coextensive with the lower passage and having a first end adjacent the first end of the wall and a second end adjacent the second end of the wall;

a first end connector disposed adjacent the first end of the wall;

a second end connector disposed adjacent the second end of the wall;

the first end connector extending from the first end of the spring, the second end connector extending from the second end of the spring;

a flexible coiled electrical cord disposed within the upper passage, the electrical cord being at least coextensive with the upper passage and having a first end electrical connector disposed adjacent the first end of the wall and a second end electrical connector disposed adjacent the second end of the wall;

a plurality of electrically powered lights disposed upon the top surface of the wall, the lights communicating electrically with the electrical cord;

a plurality of axles, each of the axles being aligned substantially parallel to the passages through the wall; and a plurality of rollers disposed beneath the wall, each of the rollers being installed upon a corresponding one of the axles and being located within the boundary of the bottom surface of the wall.

2. The portable traffic safety barrier according to claim 1 wherein the wall has a base, an upper portion, and a cap disposed atop the upper portion, the base being wider than the upper portion, the cap being wider than the upper portion and narrower than the base.

3. The portable traffic safety barrier according to claim 1, wherein the wall is formed of a material selected from the group consisting of recycled rubber and plastic.

4. The portable traffic safety barrier according to claim 1 wherein:

the first end connector comprises a ring having a semicircular outer portion and a semicircular rod slidingly disposed within the outer portion, the rod being selectively extendable from the outer portion to close the ring and retractable into the outer portion to open the ring; and the second end connector comprises a permanently closed ring.

5. The portable traffic safety barrier according to claim 1, wherein said at least one elongate wall comprises:

a first wall; and a second wall disposed laterally adjacent the first wall, the first wall and the second wall defining a planter and signage support enclosure therebetween.

* * * * *